US007299560B2

(12) United States Patent
Diaz et al.

(10) Patent No.: US 7,299,560 B2
(45) Date of Patent: Nov. 27, 2007

(54) MULTI-PURPOSE TOOL

(75) Inventors: Jeffrey Diaz, Lawrence, MA (US); Geoffrey Diaz, Lawrence, MA (US)

(73) Assignee: Topline Innovarions, LLC, Lawrence, MA (US)

( * ) Notice: Subject to any disclaimer, the term of this patent is extended or adjusted under 35 U.S.C. 154(b) by 0 days.

(21) Appl. No.: 11/318,251

(22) Filed: Dec. 22, 2005

(65) Prior Publication Data

US 2007/0011896 A1 Jan. 18, 2007

Related U.S. Application Data

(60) Provisional application No. 60/686,197, filed on Jun. 1, 2005, provisional application No. 60/653,237, filed on Feb. 15, 2005.

(51) Int. Cl.
*B43L 7/12* (2006.01)

(52) U.S. Cl. ..... 33/471; 33/451; 33/473; 33/495

(58) Field of Classification Search ..... 33/353, 33/451, 452, 464, 465, 471, 473, 495, 496, 33/497, 498, 499, 500
See application file for complete search history.

(56) References Cited

U.S. PATENT DOCUMENTS

| | | | | | |
|---|---|---|---|---|---|
| 304,196 | A | | 8/1884 | Hill | |
| 375,049 | A | | 12/1887 | Coughlin | |
| 404,451 | A | | 6/1889 | Waggoner | |
| 409,414 | A | | 8/1889 | Meek | |
| 419,615 | A | | 1/1890 | Stilwell | |
| 704,369 | A | * | 7/1902 | Pritt | 33/451 |
| 730,790 | A | | 6/1903 | Newman | |
| 784,674 | A | * | 3/1905 | Haag | 7/150 |
| 992,722 | A | | 5/1911 | Lindstrom | |
| 1,118,907 | A | | 11/1914 | Nordlie | |
| 1,159,569 | A | * | 11/1915 | Chancellor | 33/465 |
| 1,210,370 | A | | 12/1916 | Dvorak | |
| 1,298,010 | A | * | 3/1919 | Coleman | 33/451 |
| 1,585,563 | A | | 5/1926 | Schlattau | |
| 2,025,473 | A | * | 12/1935 | Plumb | 33/419 |
| 2,478,347 | A | * | 8/1949 | Warrington | 7/150 |
| 2,656,609 | A | | 10/1953 | Siggson | |
| 2,789,363 | A | * | 4/1957 | Miley | 33/347 |

(Continued)

FOREIGN PATENT DOCUMENTS

WO WO 87/02314 A1 4/1987

*Primary Examiner*—Alexander R. Smith
(74) *Attorney, Agent, or Firm*—Hamilton, Brook, Smith & Reynolds, P.C.

(57) ABSTRACT

A multi-purpose tool includes a graduated extension pivotably and lockably connected to a leveling extension. The graduated extension includes graduations for measuring length, angles, pitch, or a combination of these measurements. Angles may also be measured with a graduated disc. The leveling extension includes at least one bubble level for checking the horizontal or vertical orientation of the leveling extension. The leveling extension may include graduations for measuring length, angles, pitch, or a combination of these measurements. The tool may be extended such that the graduated and leveling extensions are collinear, having a total length of 16 inches end to end. A multi-purpose tool may be conveniently used to take the place of several separate tools such as a speed square, a T-bevel, and an extended torpedo level. The tool may also allow quick determination of the required distance between wall studs, rafters, and floor joists.

24 Claims, 9 Drawing Sheets

U.S. PATENT DOCUMENTS

| | | | | | |
|---|---|---|---|---|---|
| 3,289,301 | A | | 12/1966 | Hanson | |
| D220,061 | S | * | 3/1971 | Kerns | D10/62 |
| 3,638,527 | A | | 2/1972 | Weissenberg | |
| 3,956,830 | A | | 5/1976 | MacMillan | |
| 4,194,295 | A | | 3/1980 | Simuro et al. | |
| 4,348,815 | A | | 9/1982 | Hurt | |
| 4,394,801 | A | | 7/1983 | Thibodeaux | |
| 4,446,627 | A | * | 5/1984 | Persson | 33/497 |
| 4,451,993 | A | * | 6/1984 | Yauk | 33/472 |
| 4,481,720 | A | | 11/1984 | Sury | |
| 4,525,933 | A | | 7/1985 | Patterson | |
| 4,599,806 | A | | 7/1986 | Wright | |
| 4,611,407 | A | | 9/1986 | van Gorp | |
| 4,648,185 | A | | 3/1987 | Brandimarte | |
| 4,745,689 | A | | 5/1988 | Hiltz | |
| 4,761,890 | A | * | 8/1988 | Morrell | 33/473 |
| 4,996,777 | A | * | 3/1991 | Grosz | 33/379 |
| 5,063,679 | A | | 11/1991 | Schwandt | |
| 5,092,057 | A | | 3/1992 | Hoenig, Sr. | |
| 5,167,075 | A | | 12/1992 | Weldy et al. | |
| 5,359,782 | A | | 11/1994 | Langmaid | |
| 5,438,761 | A | | 8/1995 | Krumszyn et al. | |
| 5,446,969 | A | | 9/1995 | Terenzoni | |
| 5,452,522 | A | | 9/1995 | Kook et al. | |
| 5,459,935 | A | | 10/1995 | Paulson et al. | |
| 5,535,523 | A | | 7/1996 | Endris | |
| 5,586,395 | A | | 12/1996 | Malczewski | |
| 5,713,135 | A | | 2/1998 | Acopulos | |
| 5,904,142 | A | | 5/1999 | Policastro et al. | |
| 6,032,378 | A | | 3/2000 | Null | |
| 6,134,795 | A | | 10/2000 | Hitchcock | |
| 6,167,630 | B1 | | 1/2001 | Webb | |
| 6,314,652 | B1 | | 11/2001 | English | |
| 6,543,144 | B1 | | 4/2003 | Morin | |
| 6,568,095 | B2 | * | 5/2003 | Snyder | 33/370 |
| 6,691,423 | B2 | * | 2/2004 | Fontaine | 33/640 |
| 6,742,271 | B1 | * | 6/2004 | Rushing | 33/465 |
| D493,734 | S | | 8/2004 | Ellis | |
| 6,796,046 | B1 | | 9/2004 | May | |
| 6,829,837 | B2 | | 12/2004 | Williams | |
| 6,839,974 | B1 | * | 1/2005 | Hitchcock | 33/473 |
| 7,152,335 | B2 | * | 12/2006 | Nichols | 33/390 |

* cited by examiner

MULTI-PURPOSE TOOL

RELATED APPLICATIONS

This application claims the benefit of U.S. Provisional Application No. 60/653,237 filed Feb. 15, 2005, U.S. Provisional Application No. 60/686,197 filed Jun. 1, 2005, and U.S. Provisional Application for a "Multi-Purpose Tool," inventors Jeffrey and Geoffrey Diaz, filed Dec. 15, 2005. The entire teachings of the above application(s) are incorporated herein by reference.

BACKGROUND OF THE INVENTION

A variety of tools for measurement are necessary in the construction and carpentry arts. In particular, tools such as speed squares, T-bevels, and torpedo levels allow the artisan to determine particular angles and lengths to the necessary precision. Oftentimes persons working in confined spaces, or areas without easy access to the necessary measuring tools, are hindered in efficiently completing the necessary measuring tasks. As well, certain measurements may necessitate the use of combinations of different tools. For example, to measure a particular angle, a T-bevel and a separate angle measuring device are needed. Or in another example, to mark the positions of wall studs, a torpedo level and ruler must be used in conjunction to find the appropriate locations. The need for using two or more tools simultaneously increases the time to perform the task, as well as making the task more cumbersome.

SUMMARY OF THE INVENTION

In an embodiment of the invention, a multi-purpose tool is described that allows length and angle determinations, leveling, and other measurements to be performed with a single tool. The multi-purpose tool includes a leveling extension which has a level indicator for leveling the multi-purpose tool. Also, the multi-purpose tool includes a graduated extension marked with graduations. The graduated extension and the leveling extension are pivotably connected to each other. Also, the graduated extension has a slotted opening for moving the graduated extension axially, relative to the leveling extension while the two extensions maintain a fixed angular orientation.

The two extensions are pivotably and lockably connected to each other. The graduated extension is marked with graduations for measuring angles, length, pitch, or a combination of these measurements. The graduated extension may include holes for drawing circles when the graduated extension is rotated about the pivot point of the two extensions. The graduated extension is capable of rotating through 360 degrees with respect to the leveling extension.

The leveling extension includes at least one replaceable liquid bubble level for leveling the device. The leveling extension may also include graduations for measuring length, angle, pitch, or any combination of these measurements.

The leveling extension further includes magnets disposed on an edge of the leveling extension. The leveling extension also includes a plumb bob hole, which is preferably V-shaped for centering a plumb bob string. A groove is also disposed along the length of the leveling extension, adapted for easily positioning the multi-purpose tool on spherical or circular objects. The leveling extension also has mounting holes for easily mounting the multi-purpose tool to a surface, or for mounting an additional device to the multi-purpose tool.

The depth of the leveling extension of the multi-purpose tool is ¾ of an inch, and the width is 1½ inches. This can be advantageous in measuring and/or positioning framing members, for example.

The multi-purpose tool may include a graduated disc with graduations for determining the angle formed by the two extensions. The multi-purpose tool may have a length of at least sixteen inches when the graduated extension is positioned collinear with the leveling extension in an extended configuration.

The graduated disc also includes a clicking feature connected to the graduated disc. The clicking feature is adapted to produce a clicking sound and inhibit movement of the graduated extension when the graduated extension is positioned at certain angles with respect to the leveling extension.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
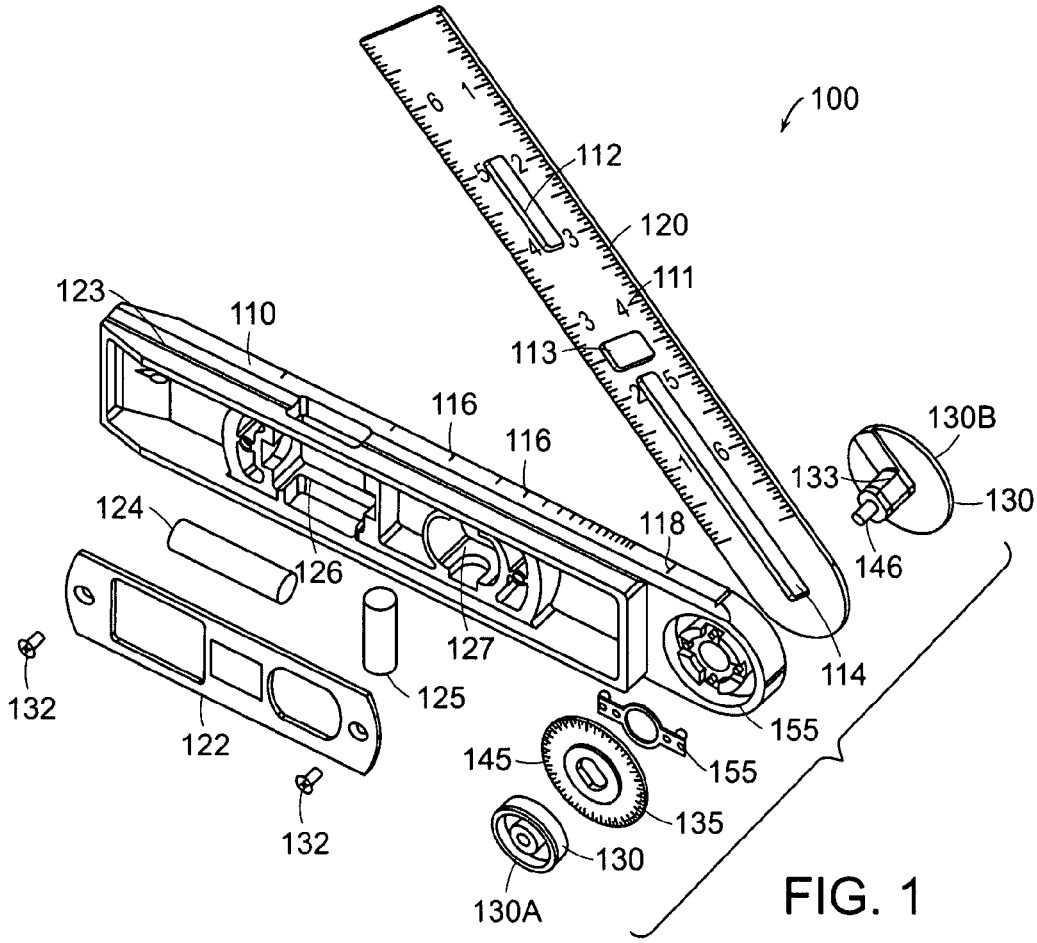
FIG. 1 presents an exploded view of a multi-purpose tool consistent with an embodiment of the invention.

An embodiment of the invention is shown in FIG. 1 in an exploded view. A multi-purpose tool 100 is comprised of a graduated extension 120 and a leveling extension 110. The extensions are pivotably connected using a hinge 130. The hinge 130 is capable of being locked and unlocked, thus allowing the two extensions to pivot around their connecting point and to allow the relative positions of the extensions to be fixed. Various types of connections, as known to those skilled in the art may be used to connect the extension and allow a lockable and pivoting action such as a standard wing nut and bolt connection, or a friction closure.

The graduated extension 120 includes graduations 111 that are used to measure length. FIG. 1 only shows graduations 111 that measure length in inches. Other length units may also be utilized. The length graduations 111 are marked in reverse order of each other on each edge of a side of the graduated extension 120. For example, if the length graduations 111 from one end to the other end of an edge of the graduated extension 120 measure from one inch to six inches, the opposite or mirroring edge will measure six inches to one inch in the same direction. This is advantageous in that length measurements may be taken in any direction needed when the extensions of the multi-purpose tool 100 are manipulated. The graduations 111 may be marked on the either side of the graduated extension 120, or both. As well, the graduations 111 may be marked on either edge of a side of the graduated extension 120, or both.

In another embodiment, the graduations 111 on the graduated extension 120 may be angle graduations. A particular angular graduation can correspond to the particular angle formed by the intersection of the graduated extension 120 and leveling extension 110 at the particular graduation. For example, if a graduation on the graduated extension 120 corresponds to a 45 degree angle, it also corresponds to the angle formed by the graduated extension 120 and the leveling extension 110. The graduations 111 may be marked on either side of the graduated extension 120, or both. As well, the graduations may be marked on either edge of a side of the graduated extension 120, or both.

Alternatively, the graduations 111 may be in terms of pitch (i.e., the ratio of rise to run) or other convenient measures utilized by those skilled in the art. It is preferable to have angular graduations of both degrees and pitch utilized in a particular embodiment of the invention.

As shown in FIG. 1, the graduated extension 120 may also have cut outs 112, 113 for viewing one or more bubble levels 124 and 125 in the leveling extension. Thus, when the graduated extension 120 is folded over the leveling extension 110, the bubble levels 124 and 125 may be viewed through the cut outs 112 and 113 as shown in FIG. 5.

Figure 5:
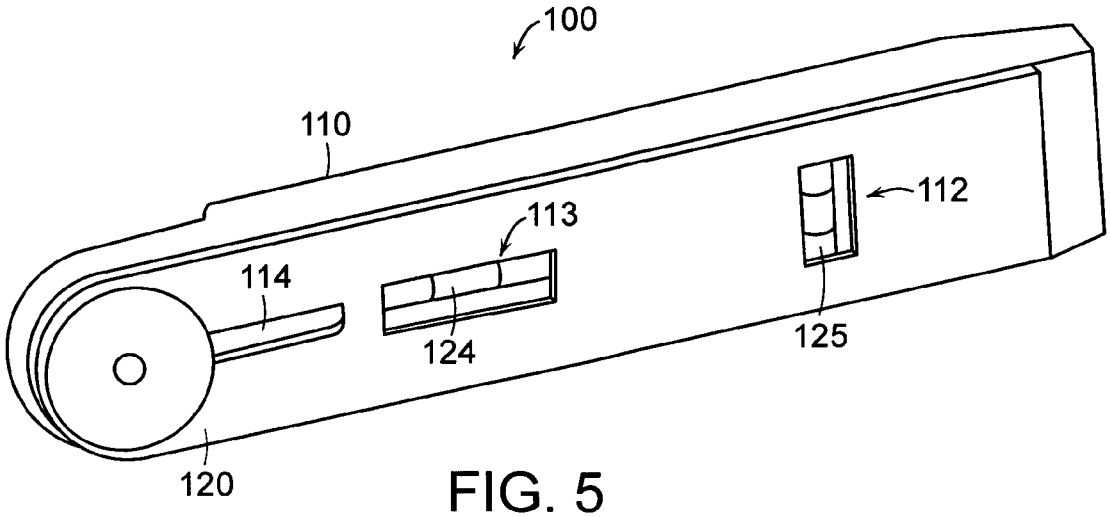
FIG. 5 presents a rear view of a multi-purpose tool in which a graduated extension is folded over a leveling extension, consistent with an embodiment of the invention.

Also as shown in FIG. 5, the width of the graduated extension 120 is substantially similar to the width of the leveling extension 110. The graduated extension 120 may also include a slotted opening 114 for changing the pivoting point between the two extensions. Thus, the graduated extension 120 may slide relative to the leveling extension 110 while maintaining the same angle of intersection, effectively operating like a T-bevel.

Figure 6:
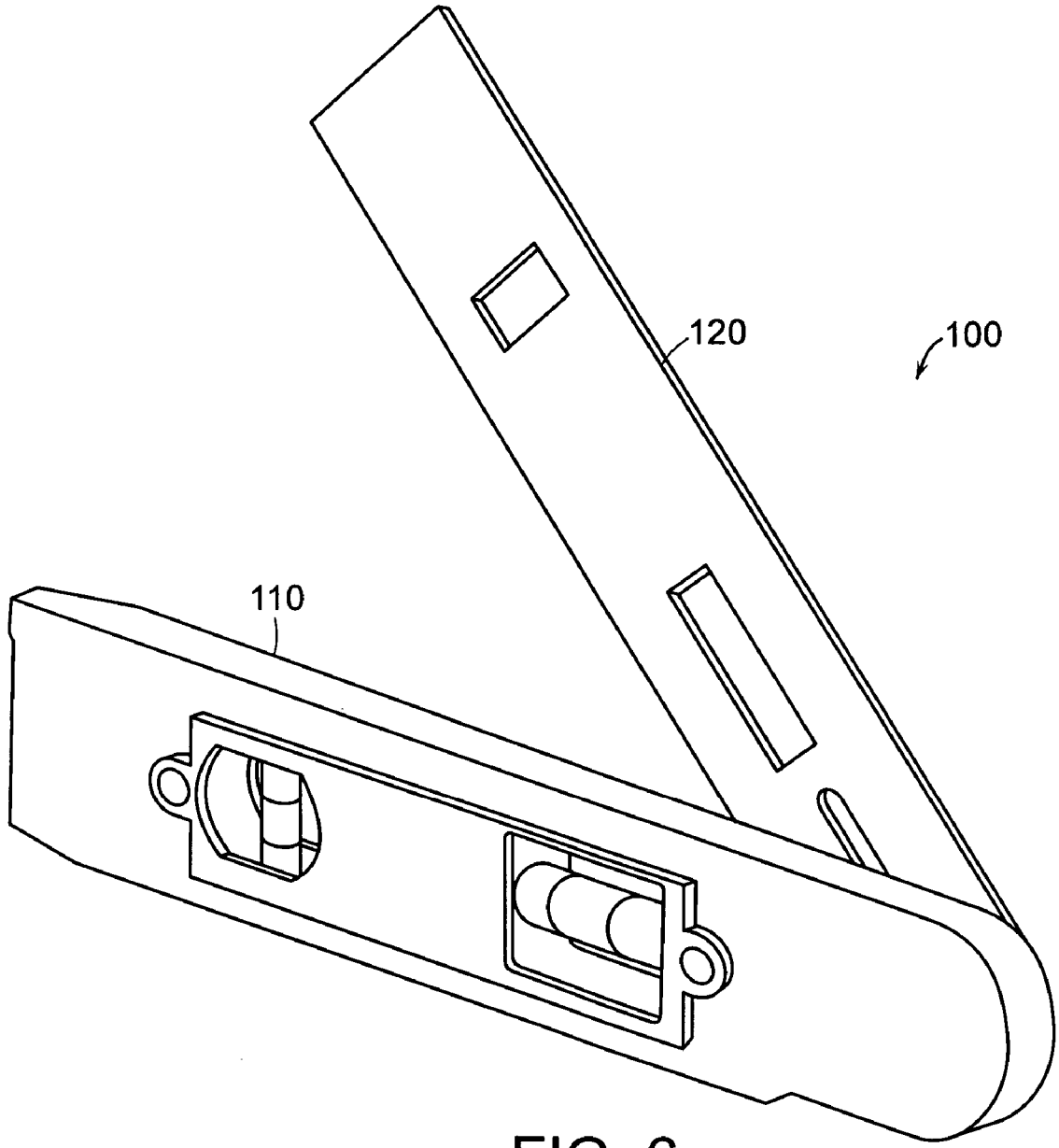
FIG. 6 presents a perspective view of a multi-purpose tool, consistent with an embodiment of the invention.

As implied in FIGS. 5 and 6, the graduated extension 120 and the leveling extension 110 are pivotable over the entire 360 degree range. Thus, any angle may be formed by pivoting the graduated extension 120 and leveling extension 110 to the desired positions.

As shown in FIG. 1, the leveling extension 110 includes at least one bubble level for leveling the multi-purpose tool 100. The embodiment shown here has two bubble levels oriented 90 degrees from one another. The horizontal bubble 124 is oriented to be collinear with the leveling extension 110. A 45 degree bubble level may also be incorporated into the leveling extension 110. The bubble levels 124 and 125 are inserted into openings 126 and 127 respectively, and held in place by a plate 122 and screws 123. The openings 126 and 127 are sized such that the bubble vials 124 and 125 fit within the center of the openings 126 and 127, but do not touch a surface on which the multi-purpose tool 100 may be placed on flush. Other means of attaching the bubble levels 124 and 125 to the leveling extension 110 may also be utilized as known to those of ordinary skill in the art.

The bubble levels 124 and 125 can be a standard size (approximately 9.8 mm in diameter). The bubble levels 124 and 125, may therefore, be replaced by any standard sized bubble level vial. This is advantageous in that the multi-purpose tool 100 need not be completely replaced if one or both of the bubble levels 124 and 125 are damaged.

Figure 2:
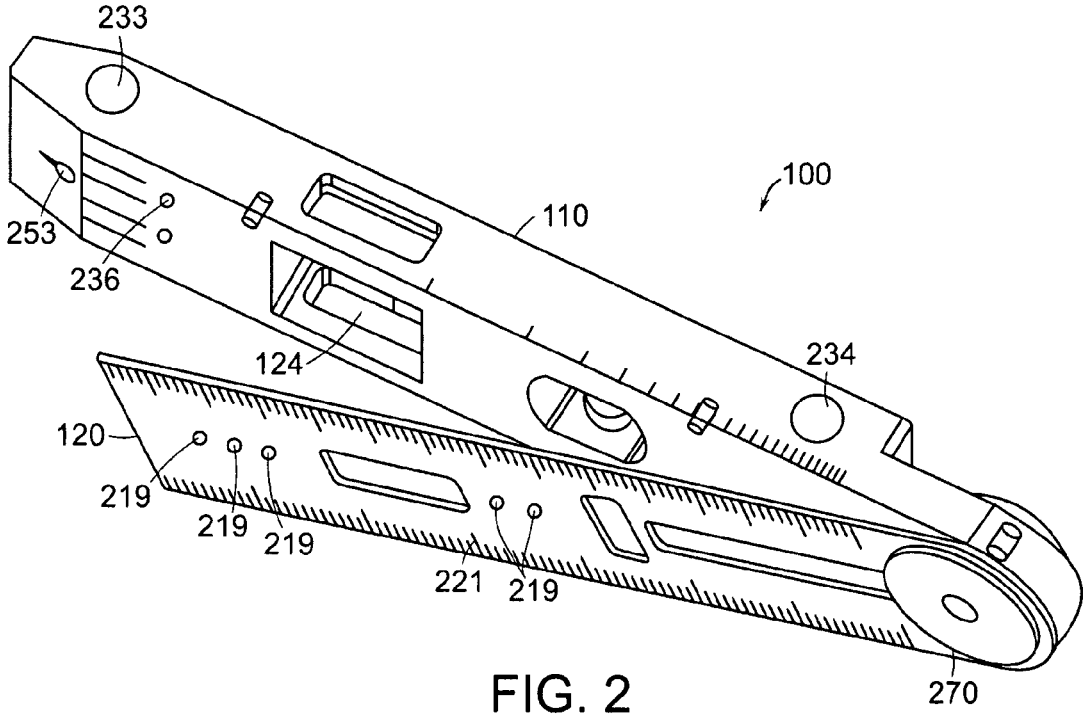
FIG. 2 presents a rear perspective of a multi-purpose tool.

Furthermore, one or more magnets may be incorporated into either extension in shown in FIG. 2. Here, two magnets 233 and 234 are located on an edge of the leveling extension 110. This allows the multi-purpose tool 100 to be fixed to a metal surface, which may be advantageous for measuring in particular situations.

Also, the leveling extension 110 includes a plumb bob hole 253 going entirely through the leveling extension 110. Preferably, the plumb bob hole 253 is in the shape of a V, or is a V-notch. Such a plumb bob hole 253 may be used to hang a plumb bob by a knotted string to determine the direction of gravity, for identifying a vertical line. The V shape of the plumb bob hole 253 ensures that the knotted string inserted through the plumb bob hole 253 for hanging the plumb bob is automatically centered. The plumb bob hole 253, can however, be any suitable shape for hanging a plumb bob string.

Alternatively, the multi-purpose tool 100 can itself be used as the plumb bob. A string can be inserted through the plumb bob hole 253, and be used to hang the multi-purpose tool 100 to determine the direction of gravity. Also, the bubble levels can be used to determine if the multi-purpose tool 100 is vertically level, whether the multi-purpose tool 100 is used to hang a plumb bob or is used as the plumb bob.

The leveling extension 110 also includes one or more mounting holes 236. The mounting holes 236 are preferably counter-sunk holes. The counter-sunk mounting holes 236 allow the graduated extension 120 to pass over the leveling extension 110 without any obstruction. The mounting holes 236 are sized to fit standard screws through them. The mounting holes 236 may be disposed on any suitable part of the leveling extension 110. This is advantageous in that the multi-purpose tool 100 may be mounted to a surface, while still allowing the graduated extension 120 the freedom to be positioned as needed. The mounting holes 236 can also be used to mount an additional device to the multi-purpose tool 100. For example, a laser level can be mounted to the multi-purpose tool 100, and used in conjunction with the multi-purpose tool 100.

The graduated extension 120 also includes a plurality of small compass holes 219 drilled along the length of the graduated extension 120. In the particular embodiment shown, the compass holes 219 are located at half inch intervals along the centerline of the graduated extension 120. The compass holes 219 are sized large enough to fit a marking device (e.g., a pencil or pen) through each compass hole 219. Thus, a circle, or a portion of a circle, can be drawn using the tool 100 by inserting the marking tool into the compass hole 219 and pivoting the graduated extension 120 in a circular motion with the marking tool, while holding a pivot point 270 fixed. For example, a circle with a three inch radius may be drawn by inserting the marking device into a compass hole 219 at a three inch mark 221 of the graduated extension 120.

Variations of how to utilize the arrangement of compass holes 219 to draw circles with the multi-purpose tool 100 are all contemplated within the scope of the invention. For example, the compass holes 219 need not all be in half inch increments, and as many compass holes 219 as desired may be utilized. As well, compass holes 219 could be disposed on the leveling extension 110. The length graduations 111 included on the graduated extension 120 can facilitate the drawing of particularly sized circles.

Figure 3:
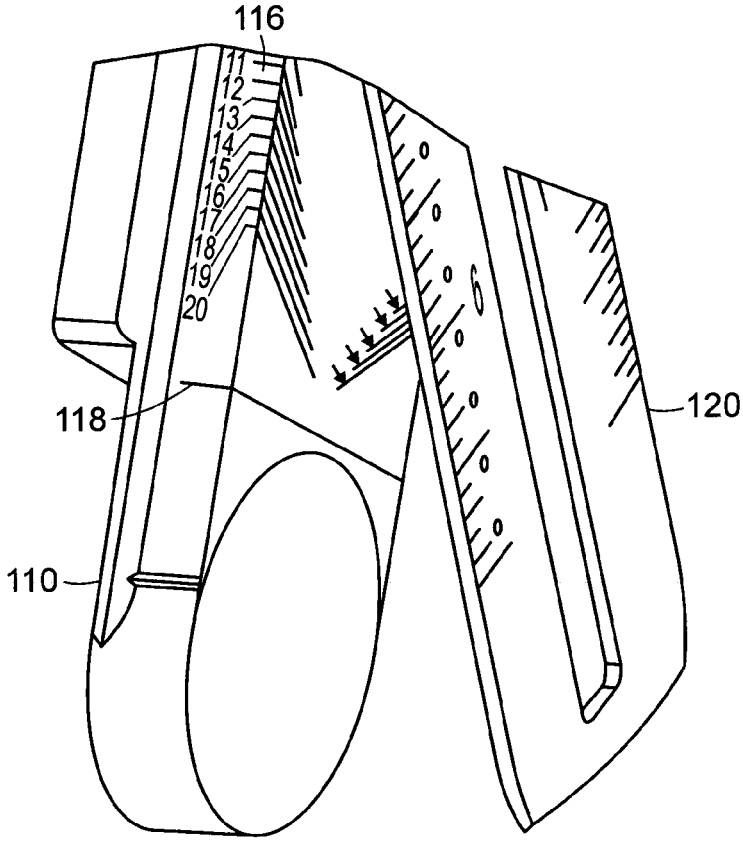
FIG. 3 presents an exploded view of one end of a multi-purpose tool.
Figure 4:
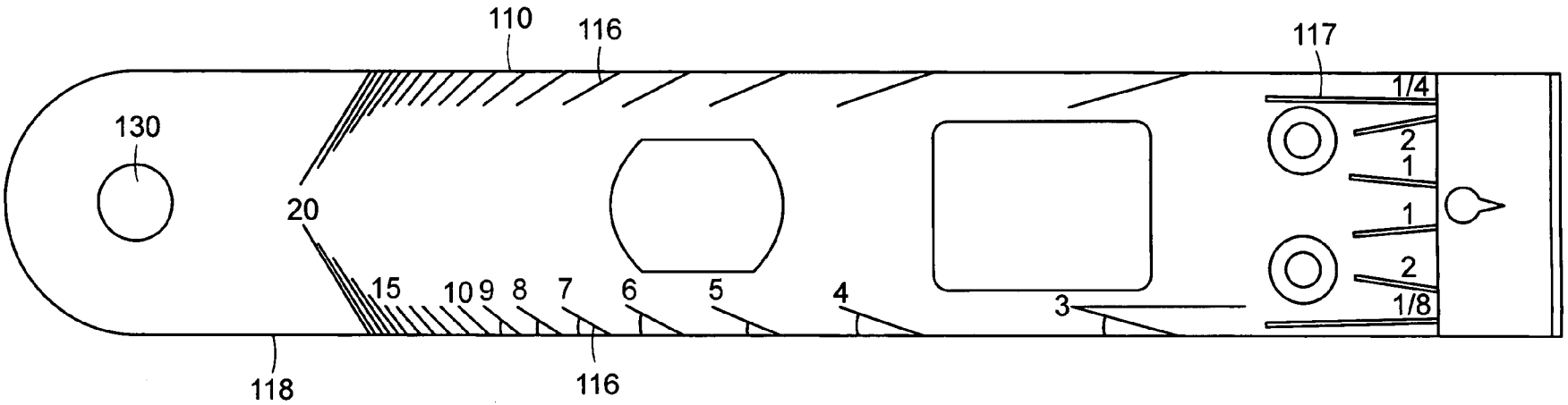
FIG. 4 presents an embodiment of a leveling extension of a multi-purpose tool.

As shown in FIGS. 3 and 4, the multi-purpose tool 100 includes graduations 116 and 117 marked on the leveling extension 110 corresponding to pitch between the leveling extension 110 and the graduated extension 120. In this embodiment, the graduations 117 marked on a side of the leveling extension 110 include pitch levels 1,2, ¼ and ⅛. The pitch levels 1 and 2 are disposed on two alternate or mirroring positions of the leveling extension 110 side to provide the freedom of moving the graduated extension 120 to either side of the leveling extension 110 as desired, while still being able to measure pitch. The pitches of 1 and 2 generally correspond to standard roofing pitches, while pitches of ¼ and ⅛ are standard in the plumbing industry. The multi-purpose tool 100, is therefore, advantageous in that it is adaptable to different types of work.

In operation, the graduated extension 120 needs to simply be aligned with the desired pitch graduation 117 to display the needed pitch. The extensions can then be locked into place if desired by tightening the hinge 130.

The graduations 116 are marked on at least one edge of the leveling extension 110. The graduations 116 correspond to pitch levels from about three to twenty. The graduations 116 extend onto a side of the leveling extension 110. The extension of the graduations 116 from the edge of the leveling extension 110 onto the side allows facilitated viewing of the graduations 116, and thus facilitated alignment of the graduated extension 120 with the leveling extension 110 to produce the desired pitch.

The pitch graduations 116 and 117 can include any range of pitch levels achievable by the multi-purpose tool 100. The graduations 117 may also be marked on at least one edge of the leveling extension 110, similar to the graduations 116. Also, the graduations 116 may be marked on the side of the leveling extension 110, similar to the positioning of the graduations 117. The pitch graduations 116 and 117 may be marked on any suitable position of the leveling extension 110. The pitch graduations 116 and 117 are advantageous in that they allows the graduations 111 on the graduated extension 120 to be dedicated to length measurement.

The leveling extension 110 also includes a ninety degree mark 118, extending from at least one edge of the leveling extension 110 onto a side of the leveling extension 110. The ninety degree mark 118 corresponds to an angle of ninety degrees formed by the leveling extension 110 and the graduated extension 120. The graduated extension 120 needs to simply be aligned with the ninety degree mark 118 with respect to the leveling extension 110 to produce the ninety degree angle. In addition to the ninety degree mark 118, the leveling extension 10 can include degree marks of any desired degree.

Figure 9:
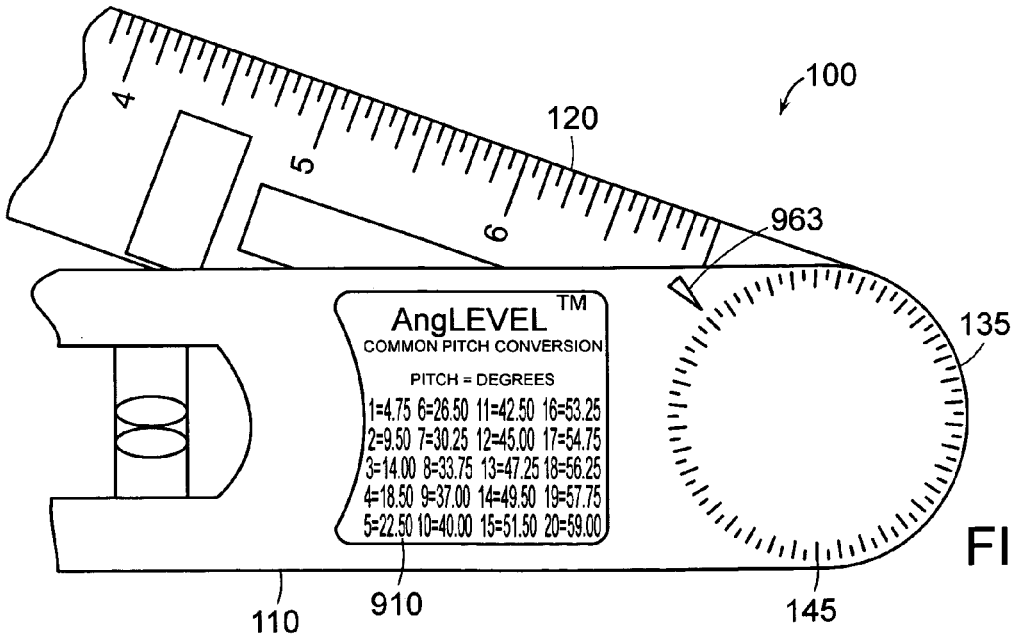
FIG. 9 depicts a multi-purpose tool with a graduated disc and a pitch conversion scale.

As shown in FIG. 9, the leveling extension 110 also includes a scale 910 which shows the conversion between pitch and degrees. By adjusting the multi-purpose tool 100 to a particular pitch therefore, the angle may be determined by either looking at the graduations 145 on a graduated disc 135 or by looking at the pitch conversion scale 910. The multi-purpose tool 100 therefore, allows the measurement and conversion of pitch and angle using one device, as opposed to using additional tools for this purpose.

As shown in FIG. 1, the leveling extension 110 also includes a groove 123 along at least one edge of the leveling extension 110. The groove 123 allows the facilitated positioning of the multi-purpose tool 100 on spherical or cylindrical objects. For example, this is especially useful in the plumbing industry where the multi-purpose tool 100 may need to be positioned on a pipe. The groove 123 would allow the multi-purpose tool 100 to be positioned on the pipe without easily falling off, as it might if the edge of the leveling extension 110 was flat.

The multi-purpose tool 100 also includes the graduated disc 135 with graduations 145. The graduated disc 135 is preferably an angle dial. Further details of the graduated disc are shown in FIG. 9. The graduations 145 correspond with the particular angle formed between the graduated extension 120 and the leveling extension 110, the particular angle designated by the graduation 145 lining up with a mark indicator 963. In the particular graduations 145 shown in this figure, quadrant graduations are used. The angles, therefore, span 0 to 90 degrees then 90 to 0 degrees, and are then repeated on the other half of the graduated disc 135. Such graduations 145 may be preferred by users who typically determine angles relative to a horizontal or vertical position.

As shown in FIG. 1, the leveling extension 110 and the graduated extension 120 are connected by a hinge 130. The hinge 130 includes two main parts, a hinge cap 130A, and a back plate 130B with a recessed portion 133. The hinge 130 is tightened or loosened to allow the leveling extension 110 and the graduated extension 120 to be fixed or move relative to one another, respectively. The flatness of the back plate 130B enables the multi-purpose tool 100 to be placed flush along a flat surface without the hinge 130 interfering with the positioning of the multi-purpose tool 100.

Figure 10:
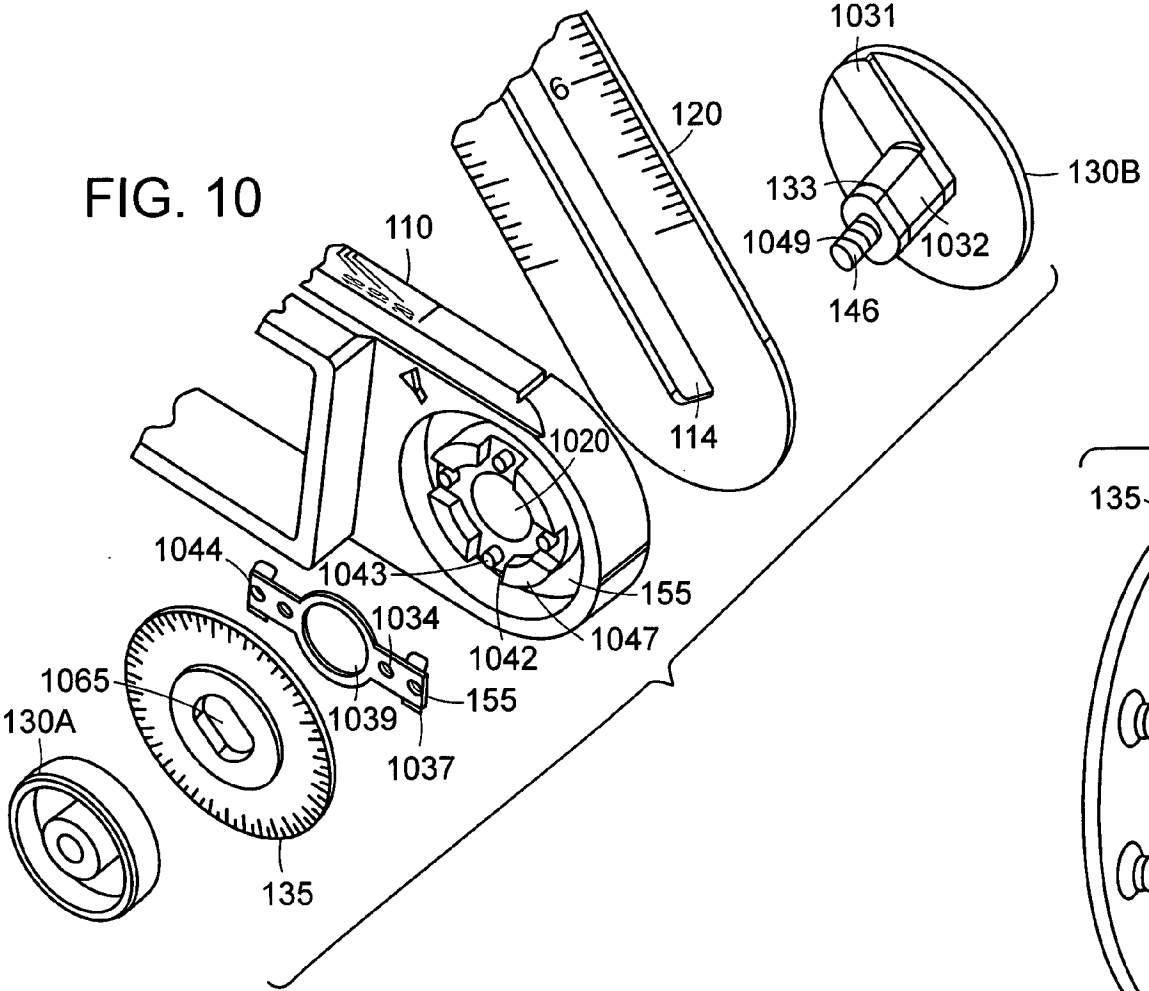
FIG. 10 shows a connection assembly of a multi-purpose tool.

Details of the hinge 130 are shown in FIG. 10. The recessed portion 133 of the back plate 130B is sized to fit through the slotted opening 114 of the graduated extension 120 without producing a tight fit, such that the graduated extension 120 is slidable with respect to the leveling extension 110. The recessed portion 133 of the back plate 130B includes flats 1032, which allow it to slide through the slot 114, due to their flat shape.

The back plate 130B also includes a slightly protruding flat shoulder 1031, which allows the back plate 130B to axially slide within the slot 114. The shoulder 1031 is shaped and sized to fit precisely within the slot 114, while still remaining slidable. A bolt 146 is inserted through the opening in the recessed portion 133 of the back plate 130B. The bolt 146 thus slides through an opening of the recessed portion 133 of the back plate 130B, through the slot 114, and through an opening 1020 in the leveling extension 110. The back of the bolt 146 is preferably flat, such that the multi-purpose tool 100 can be placed flush on a surface without any tilting that may be caused by a protruding back of the bolt 146. The graduated disc 135 with opening 1065 is then placed on top of the bolt 146 and the recessed portion 133 of the back plate 130B. The shape of the opening 1065 of the graduated disc 135 is similar to the external shape of the recessed portion 133, which allows the graduated disc 135 to easily fit onto the recessed portion 133. The hinge cap 130A can then be threaded onto the bolt on threads 1049.

By leaving the cap 130A loosely threaded, the graduated extension 120 is easily rotatable with respect to the leveling extension 110. By tightening the cap 130A on the threads 1049, the movement of the graduated extension 120 becomes inhibited. If the cap 130A is completely tightened on the threads 1049, the graduated extension 120 is locked with respect to the leveling extension 110.

The connection of the leveling extension 110 and the graduated extension 120 as described, allows the rotation of the graduated disc 135 to correspond with the rotation of the graduated extensional 20. Therefore, the measured angle between the leveling extension 110 and the graduated extension 120 is displayed on the graduated disc 135. Alternatively, any suitable means of connection may be used, such as a wing nut and bolt connection or a friction closure.

As shown in FIG. 1, the graduated disc 135 includes a clicking configuration 155. Details of the clicking configuration 155 are shown in FIG. 10. The clicking configuration 155 of the graduated disc 135 includes a spring clip 1037. The spring clip 1037 includes a circular opening 1039. Disposed on the leveling extension 110 is a four recession attachment mechanism 1042. Each of the four recesses of the attachment mechanism 1042 includes spherical shaped protrusions 1043. The spring clip 1037 includes two circular openings 1034. Also, the spring clip 1037 includes at each end tabs 1044. The circular openings 1034 are sized to fit onto two of the protrusions 1043 of the attachment mechanism 1042, either in a horizontal direction or a vertical direction. The tabs 1044 allow the spring clip 1037 to clasp between axial extensions 1047 of the attachment mechanism 1042. The large circular opening 1039 of the spring clip 1037 thus has the recessed portion 133 of the back plate 130B and the bolt 146 going through it.

The spring clip 1037 is therefore attached onto the attachment mechanism 1042. Though only two protrusions 1043 either in a horizontal or vertical direction are needed to attach the spring clip 1037 to the attachment mechanism 1042, the additional protrusions 1043 allow the attachment even if one of the protrusions 1043 becomes damaged.

Figure 11:
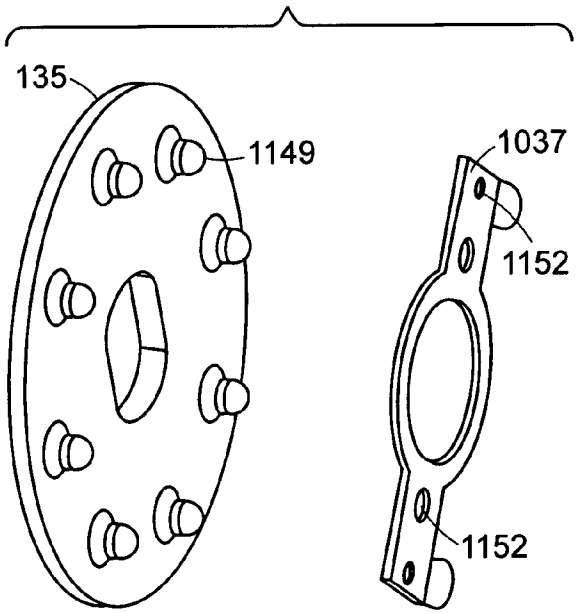
FIG. 11 shows details of the back portion of a graduated disc used with a multi-purpose tool.
Figure 12C:
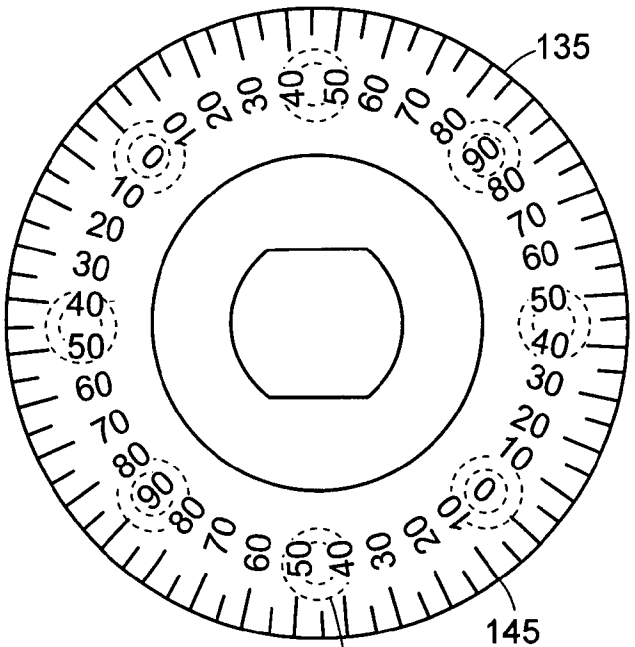
FIGS. 12A-12C show further details of the back portion, side portion, and front portion of the graduated disc of FIG. 11 used with a multi-purpose tool.
Figure 12B:
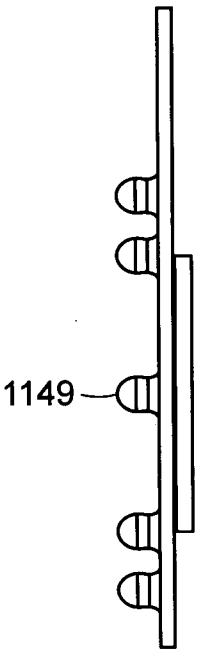
Figure 12A:
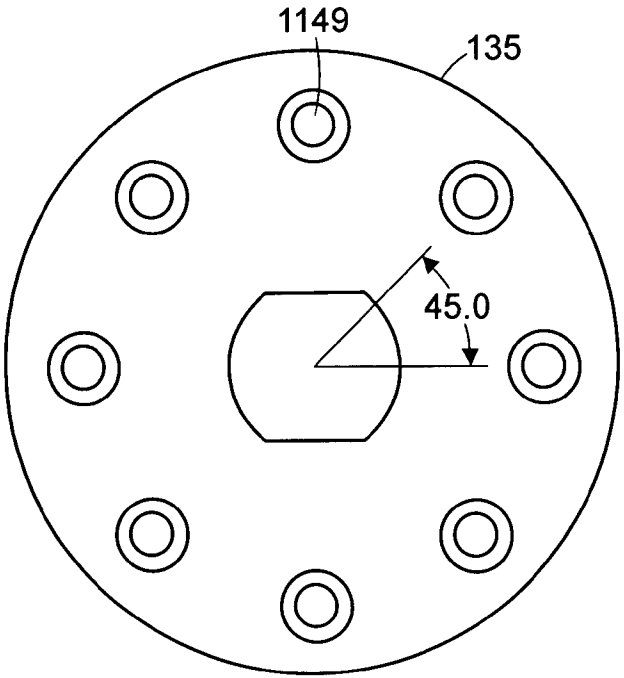

The back of the graduated disc 135 is shown in FIG. 11. As shown in FIG. 11 the edge along the circumference of the back of the graduated disc 135 includes evenly spaced sphere bearings 1149. Further details of the graduated disc 135 are shown in FIG. 12A-12C. FIG. 12A shows a rear view of the graduated disc 135 and the 45 degree spacing between the sphere bearings 1149. As shown in the front view of the graduated disc 135 in FIG. 12C, the sphere bearings 1149 are positioned at 0 degrees, 45 degrees, and 90 degrees in each of the two quadrants of the graduated disc 135. Each sphere bearing 1149 corresponds to the sphere bearing 1149 directly horizontal to it, which marks the same angle. A side view of the graduated disc 135 with sphere bearings 1149 is shown in FIG. 12B.

As shown in FIG. 11, when the graduated disc 135 is turned while the graduated extension 120 is positioned at angles of 0 degrees, 45 degrees, or 90 degrees with respect to the leveling extension 110, the corresponding horizontal sphere bearings 1149 partially fit within a set of circular openings 1152 on both edges of the spring clip 1037. The circular openings 1152 have a smaller diameter than the sphere bearings 1149, allowing the sphere bearings 1149 to partially fit within the circular openings 1152. This produces a clicking sound indicating that a certain angle is formed between the leveling extension 110 and the graduated extension 120. Additionally, the partial fitting of the two corresponding sphere bearings 1149 within the circular openings 1152 tends to inhibit movement of the graduated extension 120, unless additional force is applied to further rotate the graduated extension 120 to a different angle with respect to the leveling extension 110.

The clicking configuration 155 is advantageous in that it allows the user to know when the extensions are positioned at certain common angles such as 0 degrees, 45 degrees, and 90 degrees. In this way, the user need not constantly rotate and position the extensions by manipulating the graduated disc 135. The user knows when a certain angle is formed by simply looking at the multi-purpose tool 100, hearing the clicking sound, and by the inhibited movement of the graduated extension 120. Alternatively, any combination of additional spring clips and bearings may be used to produce a combination of desired features. For example, the sphere bearings 1149 could be positioned at various angles, and are not limited to being positioned at 0 degrees, 45 degrees, and 90 degrees.

Of course, other variations on the graduations utilized in this embodiment, and others, are within the scope of the invention. For example, the graduated disc 135 may, instead of using quadrant graduations, utilize a range of 0 to 360 degrees or 0 to 180 degrees. Also, the graduations may be marked in mitre angles, i.e., the actual angle between the two extensions divided by two, to facilitate the making of mitre cuts. As well, the graduated disc 135 may incorporate more than one type of graduation on a side of the dial or two different types of graduations, one type on each side of the disc. Pitch may be measured on the graduated disc 135 and angular degrees by markings on the leveling extension 110. As well, angle graduations may also still be incorporated on the graduated extension 120. The graduated disc 135 may also have angle graduations on the disc and corresponding pitch graduations on the cap 130A, or the pitch graduations on the disc and the angle graduations on the cap 130A. As well, the graduated disc 135 may be a clear color with a colored indicator line. The portion of the leveling extension 110 underneath the clear graduated disc 135 can be marked with pitch and or/angle graduations, such that the colored indicator points to the relevant graduation when the multi-purpose tool 100 is manipulated to different angles and/or pitch. All these variations, and others apparent to those of ordinary skill in the art, are within the scope of this embodiment.

Figure 8:
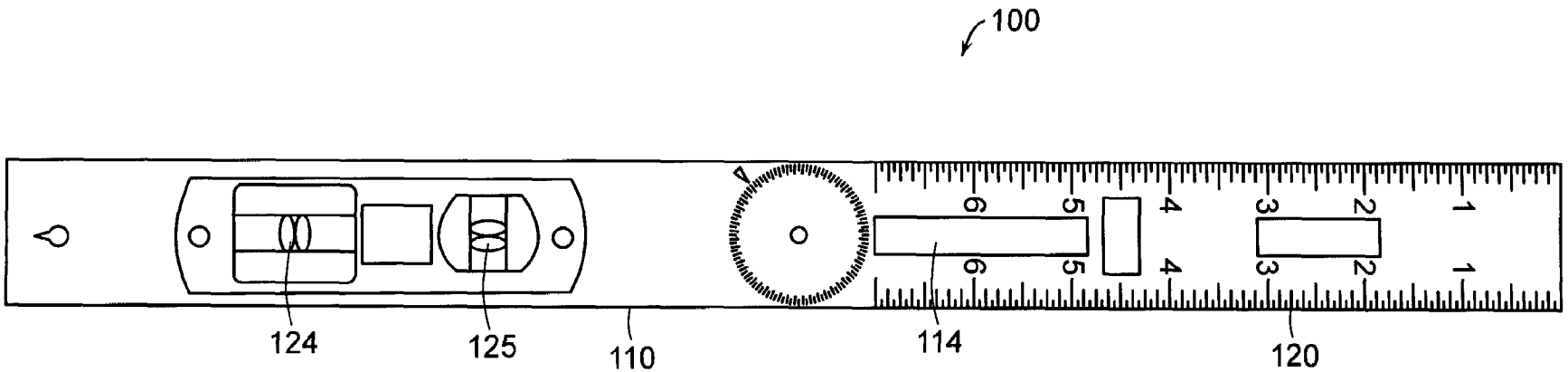
FIG. 8 depicts a multi-purpose tool in an extended position.

As shown in FIG. 8, the leveling extension 110 and graduated extension 120 are sized such that when they are positioned in a collinear orientation with the graduated extension 120 fully extended away from the leveling extension 110, the total extent of the length of the two extensions is substantially sixteen inches. In a related embodiment, the fully extended length may be more than 16 inches with an appropriate marking showing the extent of sixteen inches. The extended length of the multi-purpose tool 100 can be manipulated by sliding the graduated extension 120 axially, relative to the leveling extension 110 using the slot. 114 and placing the graduated extension 120 and the leveling extension 110 collinear to each other. The extensions may be further oriented such that when the extension are fully extended, the edges of the extensions form an extended collinear edge.

Because of its extended length of 16 inches, the multi-purpose tool 100 may also be used to provide a quick measurement between floor joists, wall studs, and roof rafters. Typically, such structures are spaced precisely 16 inches apart. When the multi-purpose tool 100 is fully extended and sized to be 16 inches in length, the multi-purpose tool 100 provides a quick measurement of the appropriate distance between the edges of wall studs by simply placing the multi-purpose tool 100 edges in the appropriate position. The horizontal bubble 124 of the leveling extension 110 can be used to insure that the measurement is made in a straight line. Alternatively, if the multi-purpose tool 100 is longer than 16 inches when extended, such a measurement may still be made by demarking a 16 inch length on an edge of the fully extended multi-purpose tool 100.

The dimensions of the leveling extension 110 are also very useful in measuring a typical framing member. The depth of the leveling extension 110 is ¾ of an inch, and may therefore be use to measure the center of the framing member, or stud center. The width of the leveling extension 110 is 1.5 inches, and can thus be used for marking the edges of a framing member.

The types of materials for constructing the multi-purpose tool 100 includes the range of materials used to make standard measurement tools in the art. It is generally desirable to construct the parts of the multi-purpose tool 100 in a manner such that they withstand the typical environment they would be subject to in general construction and carpentry use (e.g., capable of sustaining a drop of a certain distance without substantial damage to the multi-purpose tool). For example, it is preferred that the graduated extension 120 be made of 300 series stainless steel with graduations marked by etching and painting. The leveling extension 110 may be made of a zinc alloy or aluminum with the bubble levels set to not contact a surface when the leveling extension is flush on the surface. The graduated disc 135 may also be made of stainless steel, or any suitable material. The bubble levels 124 and 125 may include a fluid capable of fluorescence for use in low lighting situations.

Figure 7:
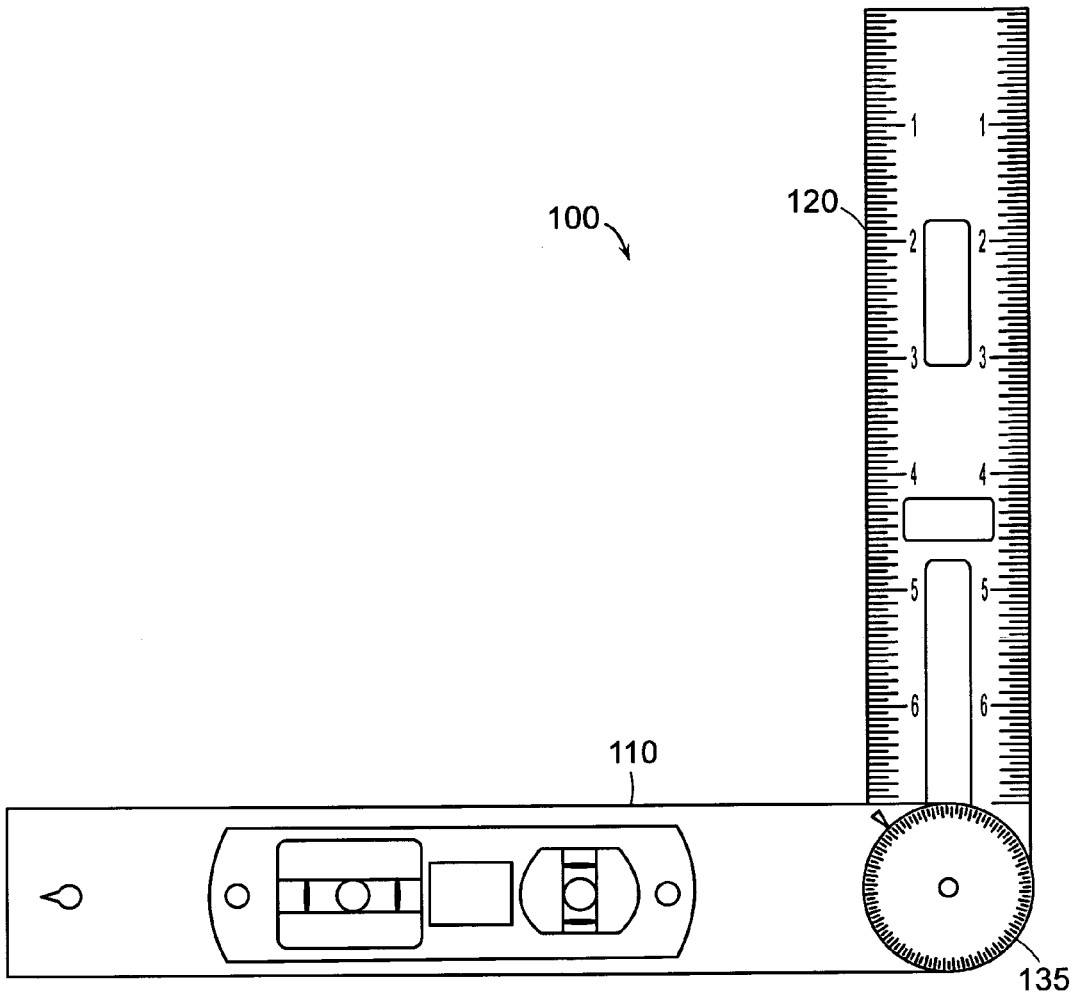
FIG. 7 depicts a multi-purpose tool in accord with an embodiment of the invention, configured to present a 90 degree angle.

Variations of the previously described multi-purpose tool 100, may be used to perform a number of standard carpentry measurements without the aid of further tools or devices. In one example, the graduated extension 120 is locked such that its longitudinal axis is perpendicular to the longitudinal axis of the leveling extension 110 as shown in FIG. 7. In such a configuration, the multi-purpose tool 100 acts as a standard speed square to allow the tracing of a perpendicular line to a planar surface. For example, the leveling extension 110 is positioned against the planar surface of a stair and the graduated extension 120 allows a trace to be made along its edge which is perpendicular to the planar surface. The graduations of the graduated extension 120 may be used simultaneously to determine a particular length.

Figure 13:
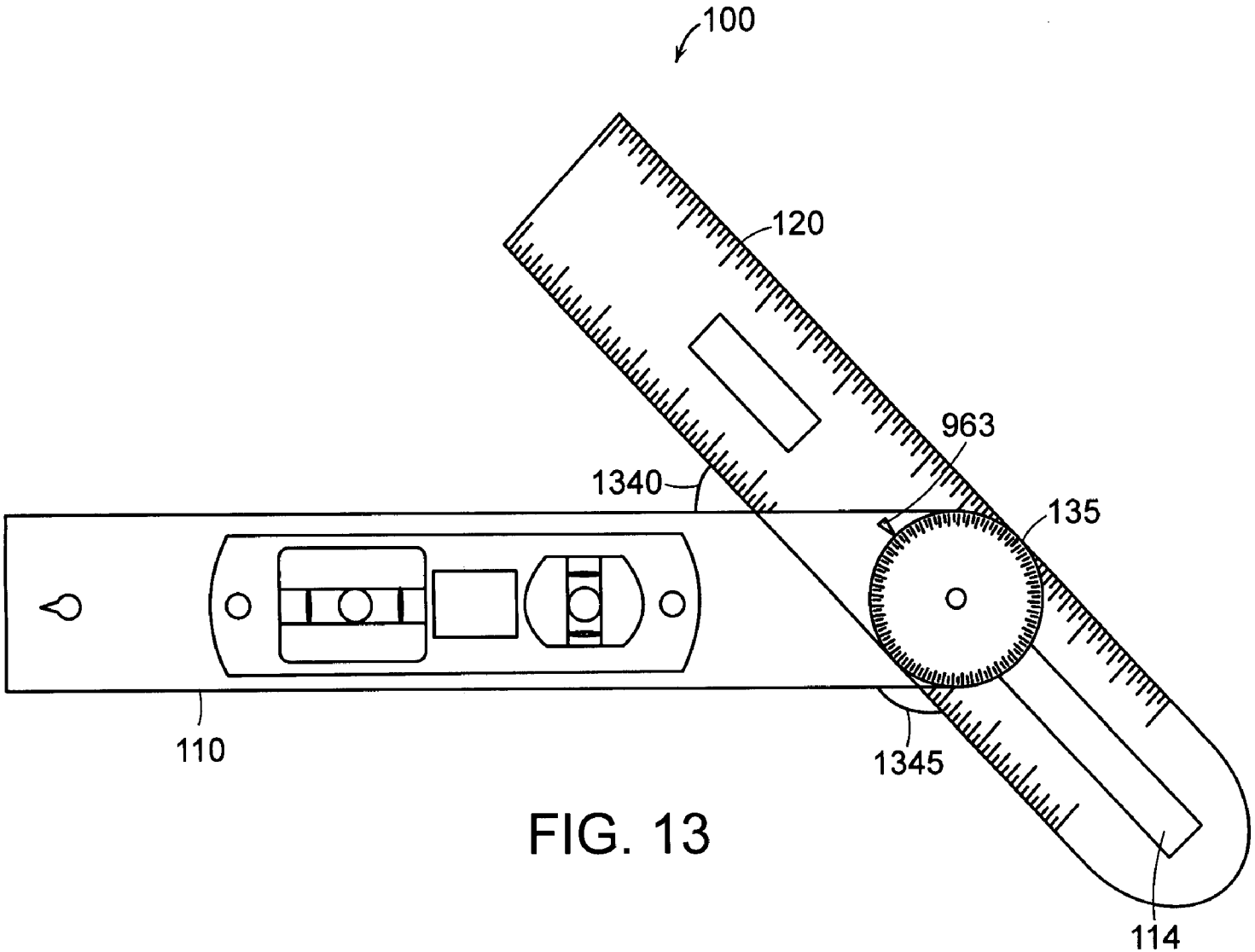
FIG. 13 depicts a multi-purpose tool being used a T-bevel, in accord with an embodiment of the invention.

FIG. 13 shows the multi-purpose tool 100 being used as a T-bevel, in accord with embodiments of the invention. Similar to what is shown in other embodiments of the invention herein, the slot 114 of the graduated extension 120 allows the graduated extension 120 to slide relative to the leveling extension 110 without changing the angle of intersection 1340. Thus, the complementary angle 1345 can easily be identified and used when measuring and marking. Furthermore, the angle 1340 is readable from the graduated disc 135, and the graduated extension 120 and the leveling extension 110 are pivotable over 360 degrees. The latter two features are not achievable by a conventional T-bevel.

The graduated disc 135 also allows the multi-purpose tool 100 to operate more accurately than a T-bevel. When an angle is identified by the two extensions 110 and 120, the graduated extension 120 may slide using slot 114 to identify a complementary angle, for example. In order to ensure that the same angle is maintained after sliding, a user can check that the angle indicated by the mark indicator 963 is the same before and after sliding. T-bevels, in contrast, do not have an angle indicator so that error may creep into the angle as a user slides the extensions relative to each other.

The multi-purpose tool 100 can also perform the standard function of a T-bevel by pivoting the two extensions to form an angle of a construct, e.g., the angle between a roof and the front of a dormer of a building. The angle may be locked into place and the multi-purpose tool 100 moved to form the same angle on a piece of wood or other construction material. As well, in one embodiment, the slot 114 of the graduated extension 120 allows the graduated extension 120 to slide relative to the leveling extension 110 while maintaining a particular intersection angle.

Thus, the multi-purpose tool 100 has all the functions of a T-bevel. The multi-purpose tool 100, however, has the added feature that the graduated extension 120 and leveling extension 110 may form any angle between 0 and 360 degrees, unlike a T-bevel which typically has a minimum angle that can be identified before the arms contact each other. Thus, the multi-purpose tool 100 can be utilized to determine very acute angles or extremely obtuse angles that a T-bevel cannot determine.

The multi-purpose tool 100 may also be used as a level to insure that a structure is truly perpendicular to the direction of gravity. For example, if the graduated extension 120 is locked in an extended, collinear orientation to the leveling extension 110, (see FIG. 8) and the edges of the graduated extension 120 and the leveling extension 110 are placed against two rafters of a building, one can determine whether the rafters are in a horizontal plane relative to each other. The multi-purpose tool 100 provides an advantage over typical torpedo levels, which are generally 7 to 9 inches in length, by providing a level that acts over an extended length range while not being overly bulky since the extensions of the multi-purpose tool 100 can be folded. The folded length of the multi-purpose tool 100 is approximately 9 inches, and can thus act as a standard torpedo level, with the added feature of being extendable. This may be particularly useful to workers who are working on ladders or confined spaces, where a large level would be difficult to carry and maneuver.

The multi-purpose tool 100 can further be used for determining the angle of a rafter. For example, the angle of the rafter can be determined by positioning the edge of the graduated extension 120 adjacent to the edge of an angled rafter. The leveling extension 110 is pivoted until the horizontal bubble 124 indicates that the leveling extension 110 is horizontal. The angle can then be read from the graduation that marks the intersection between the leveling extension 110 and the graduated extension 120.

The multi-purpose tool 100 can also be used to find an angle of a roof. The edge of the graduated extension 120 is placed adjacent to the roof surface. The leveling extension 110 is pivoted until the horizontal bubble 124 indicates level. The angle of the roof may be determined from graduations 145 on the graduated disc 135 or as discussed previously, by angle graduations marked on the graduated extension 120.

Other embodiments of the invention utilize any one or more of the various features described in various multi-purpose tool embodiments discussed herein. For example, a T-bevel in which one of the arms includes a bubble level is included within the scope of the present invention. Such a device may utilize two arms that rotate 360 degrees relative to one another, while allowing slidable positioning between the arms that are oriented at a particular angle. Further embodiments of the invention may utilize one of the described embodiments herein where one or more of the features are not utilized. For example, the multi-purpose tool may be greater than or less than 16 inches in length when the extensions are positioned in the fully extended configuration.

While this invention has been particularly shown and described with references to preferred embodiments thereof, it will be understood by those skilled in the art that various changes in form and details may be made therein without departing from the scope of the invention.

What is claimed is:

1. A multi-purpose tool comprising:

a leveling extension including a level indicator for leveling the multi-purpose tool;

a graduated extension marked with graduations, the graduated extension and the leveling extension being pivotably connected to each other, the graduated extension having a slotted opening for moving the graduated extension axially, relative to the leveling extension while the two extensions maintain a fixed angular orientation a graduated disc with graduations for determining the angle formed by the graduated extension and the leveling extension; and a clicking feature connected to the graduated disc, adapted to produce a clicking sound and inhibit movement of the graduated extension when the graduated extension is positioned at certain angles with respect to the leveling extension, a back face of the graduated disc having a plurality of bearings that partially fit within openings of a clip mechanism when the graduated disc is at certain angles with respect to the leveling extension to produce a clicking sound.

2. The multi-purpose tool of claim 1, wherein the graduated extension is capable of rotating through 360 degrees with respect to the leveling extension.

3. The multi-purpose tool of claim 1, wherein the multi-purpose tool has a length of sixteen inches when the graduated extension is positioned collinear with the leveling extension, the graduated extension and the leveling extension being fully extended.

4. The multi-purpose tool of claim 1, wherein the multi-purpose tool is adapted to extend to a length of sixteen inches when the graduated extension is positioned collinear with the leveling extension.

5. The multi-purpose tool of claim 1, wherein the leveling extension further comprises magnets disposed on the leveling extension.

6. The multi-purpose tool of claim 1, further comprising a plumb bob hole disposed on the leveling extension, the hole being V-shaped.

7. The multi-purpose tool of claim 1, further comprising a groove disposed on and extending the length of an edge of the leveling extension.

8. The multi-purpose tool of claim 1, wherein an edge of at least one of the leveling extension and graduated extension is marked with graduations corresponding to pitch.

9. The multi-purpose tool of claim 1, wherein a face of the leveling extension is marked with graduations corresponding to pitch.

10. The multi-purpose tool of claim 1, wherein the leveling extension further comprises mounting holes, adapted to mount the multi-purpose tool to a surface.

11. The multi-purpose tool of claim 10, wherein the mounting holes are adapted to allow the mounting of an additional device to the multi-purpose tool.

12. The multi-purpose tool of claim 1, further comprising a plurality of holes along the length of the graduated extension, each hole sized large enough to fit a marking device through the hole.

13. The multi-purpose tool of claim 1, wherein the depth of the leveling extension is ¾ of an inch, and the width is 1½ inches.

14. The multi-purpose tool of claim 1, wherein the graduations on the graduated extension corresponds to length.

15. The multi-purpose tool of claim 1, further comprising a locking mechanism capable of locking the graduated extension with respect to the leveling extension.

16. The multi-purpose tool of claim 1, wherein the level indicator is a replaceable bubble vial.

17. A multi-purpose tool comprising:

a leveling extension including a level indicator for leveling the multi-purpose tool, the leveling extension having a depth of about ¾ of an inch and a width of about 1½ inches;

a graduated extension marked with graduations for measuring length, the graduated extension capable of rotating through 360 degrees with respect to the leveling extension, the graduated extension and the leveling extension being pivotably connected to each other;

an angle indicator indicating the angle between the leveling extension and the graduated extension;

a slotted opening on the graduated extension for moving the graduated extension axially, relative to the leveling extension while the two extensions maintain a fixed angular orientation, the multi-purpose tool having a length of sixteen inches when the graduated extension is positioned collinear with the leveling extension, the graduated extension and the leveling extension being fully extended;

a locking mechanism capable of locking the graduated extension with respect to the leveling extension;

an angle dial with graduations for determining the angle formed by the graduated extension and the leveling extension, the graduation lining up with the angle indicator to determine the angle;

a clicking feature connected to the angle dial, adapted to produce a clicking sound and inhibit movement of the graduated disc when the graduated extension is positioned at certain angles with respect to the leveling extension, a back face of the graduated disc having a plurality of bearings that partially fit within openings of a clip mechanism when the graduated disc is at certain angles with respect to the leveling extension to produce the clicking sound; and graduations corresponding to pitch marked on at least one of the leveling extension and graduated extension.

18. The multi-purpose tool of claim 17, wherein the leveling extension further comprising magnets disposed on an edge of the leveling extension.

19. The multi-purpose tool of claim 17, further comprising a plumb bob hole disposed on the leveling extension, the hole being V-shaped.

20. The multi-purpose tool of claim 17, further comprising a groove disposed on and along the length of an edge of the leveling extension.

21. The multi-purpose tool of claim 17, wherein the level indicator is a replaceable bubble vial.

22. The multi-purpose tool of claim 17, further comprising mounting holes disposed on the leveling extension, adapted to mount the multi-purpose tool to a surface.

23. The multi-purpose tool of claim 22, wherein the mounting holes are adapted to allow the mounting of an additional device to the multi-purpose tool.

24. The multi-purpose tool of claim 17 further comprising a plurality of holes on the length of the graduated extension, each hole sized large enough to fit a marking device through the hole.

* * * * *

UNITED STATES PATENT AND TRADEMARK OFFICE

CERTIFICATE OF CORRECTION

PATENT NO. : 7,299,560 B2
APPLICATION NO. : 11/318251
DATED : November 27, 2007
INVENTOR(S) : Jeffrey Diaz and Geoffrey Diaz It is certified that error appears in the above-identified patent and that said Letters Patent is hereby corrected as shown below:

On the Title page, item (73), under Assignee please delete "Topline Innovarions, LLC" and insert -- Topline Innovations, Inc. --.

Signed and Sealed this

Twenty Second Day of April, 2008

JON W. DUDAS
*Director of the United States Patent and Trademark Office*